US009789681B2

(12) United States Patent
Takahashi

(10) Patent No.: US 9,789,681 B2
(45) Date of Patent: Oct. 17, 2017

(54) SCREEN PRINTING APPARATUS INCLUDING SCRAPER WITH CURVED PORTION HAVING OPENING

(71) Applicant: HONDA MOTOR CO., LTD., Tokyo (JP)

(72) Inventor: Shinya Takahashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/215,586

(22) Filed: Jul. 21, 2016

(65) Prior Publication Data

US 2017/0021610 A1 Jan. 26, 2017

(30) Foreign Application Priority Data

Jul. 23, 2015 (JP) ..... 2015-145844

(51) Int. Cl.

| | |
|---|---|
| ***B41F 15/44*** | (2006.01) |
| ***B41F 15/08*** | (2006.01) |
| ***B41F 15/42*** | (2006.01) |
| ***B41F 15/46*** | (2006.01) |

(52) U.S. Cl.
CPC ..... *B41F 15/0881* (2013.01); *B41F 15/423* (2013.01); *B41F 15/46* (2013.01)

(58) Field of Classification Search
CPC ..... B41F 15/44; B41F 15/40; B41F 15/08; B41F 15/0881; B41F 15/423; B41F 15/46
USPC ..... 101/123
See application file for complete search history.

(56) References Cited

U.S. PATENT DOCUMENTS 5,027,703 A * 7/1991 Hancy ..... B41F 15/44 101/123
5,685,221 A * 11/1997 Newman ..... B41F 15/44 101/123
2013/0269553 A1* 10/2013 Nishimoto ..... B41F 15/0818 101/123

FOREIGN PATENT DOCUMENTS

JP 2011-020395 2/2011
JP 2013161871 A * 8/2013
JP 2013184402 A * 9/2013

* cited by examiner

*Primary Examiner* — Leslie J Evanisko
(74) *Attorney, Agent, or Firm* — Mori & Ward, LLP

(57) ABSTRACT

A printing apparatus includes a screen, a scraper, and a squeegee. The screen has a screen surface which has a width direction and which is placed on a workpiece. The scraper is movable along the screen surface in a first direction perpendicular to the width direction so as to coat the screen surface with a paste. The scraper includes an upper portion and a curved portion. The upper portion extends from an upper end to a lower end of the upper portion toward the screen surface. The curved portion is connected to the lower end of the upper portion. The curved portion has a curved shape projecting toward a second direction opposite to the first direction. The curved portion has an opening extending in the width direction. The squeegee is movable along the screen surface so as to transfer the paste to the workpiece.

16 Claims, 6 Drawing Sheets

SCREEN PRINTING APPARATUS INCLUDING SCRAPER WITH CURVED PORTION HAVING OPENING

CROSS REFERENCE TO RELATED APPLICATIONS

The present application claims priority under 35 U.S.C. §119 to Japanese Patent Application No. 2015-145844, filed Jul. 23, 2015, entitled "Printing Apparatus." The contents of this application are incorporated herein by reference in their entirety.

BACKGROUND

1. Field

The present disclosure relates to a printing apparatus.

2. Description of the Related Art

In general, using a screen a screen printing is adopted to perform printing on a workpiece by applying an application material, such as an ink or a paste, thereon. For example, Japanese Unexamined Patent Application Publication No. 2011-20395 discloses a printing apparatus including a screen, a scraper, and a squeegee. The screen is disposed above a print stage. The scraper is disposed above the screen and coats the screen with a transfer material by moving on the screen. The squeegee transfers the transfer material to a substrate, which is placed below the screen, by moving on the screen.

The scraper includes a blade and an auxiliary blade. The blade extends downward to the print stage and coats the screen with the transfer material by using a lower end portion thereof. The auxiliary blade is connected to the blade. The auxiliary blade extends substantially continuously from a position on the blade by a predetermined length in a moving direction in which the scraper moves to coat the screen. The position is separated from an end surface, facing the print stage, of the lower end portion of the blade.

It is described that, with such a structure, the scraper can uniformly coat the screen with the transfer material, and stability of transfer can be increased.

Moreover, a water-repellent layer is disposed on a surface of the auxiliary blade facing the screen (hereinafter, also referred to as an "inner surface"). Therefore, a sealing material adhering to the auxiliary blade can be easily peeled off the auxiliary blade and can be dropped to a position that is located near the lower end portion of the blade, below the auxiliary blade, and in the moving direction of the blade.

SUMMARY

According to one aspect of the present invention, a printing apparatus includes a screen, a scraper, and a squeegee. The screen is placed on a workpiece. The scraper coats the screen with a paste by moving on the screen. The squeegee transfers the paste, with which the screen has been coated by the scraper, to the workpiece by moving on the screen. The scraper includes a vertical portion and a curved portion. The vertical portion extends toward the screen in a vertical direction. The curved portion is curved from a lower end of the vertical portion in a direction opposite to a moving direction in which the scraper moves to coat the screen with the paste. The curved portion has an opening that extends in a horizontal width direction that crosses the moving direction.

According to another aspect of the present invention, a printing apparatus includes a screen, a scraper, and a squeegee. The screen has a screen surface which has a width direction and which is to be placed on a workpiece. The scraper is to be movable along the screen surface in a first direction perpendicular to the width direction so as to coat the screen surface with a paste. The scraper includes an upper portion and a curved portion. The upper portion extends from an upper end to a lower end of the upper portion toward the screen surface in a direction perpendicular to the screen surface. The curved portion is connected to the lower end of the upper portion and extending in the width direction. The curved portion has a curved shape projecting toward a second direction opposite to the first direction viewed in the width direction. The curved portion has an opening extending in the width direction. The squeegee is to be movable along the screen surface so as to transfer to the workpiece the paste with which the screen has been coated by the scraper.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
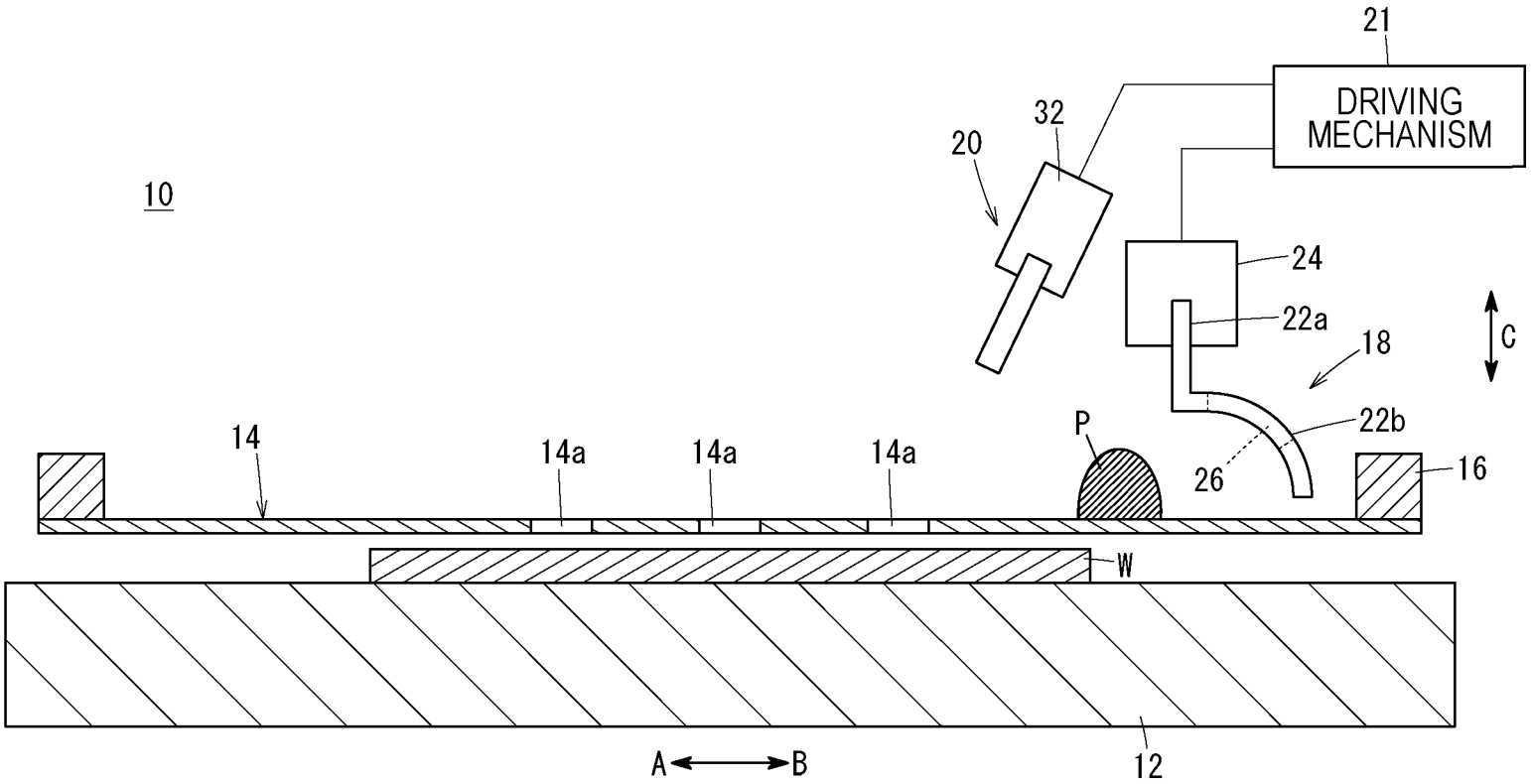
FIG. 1 is a schematic side view of a printing apparatus according to an embodiment of the present disclosure.

The embodiments will now be described with reference to the accompanying drawings, wherein like reference numerals designate corresponding or identical elements throughout the various drawings.

Referring to FIG. 1, a printing apparatus 10 according to an embodiment of the present disclosure includes a print base 12 on which a workpiece W is placed. A screen 14, which is supported by a frame 16, is disposed above the print base 12 so as to extend parallel to the workpiece W. The screen 14 is a mesh screen in which openings 14*a*, corresponding to a print shape, are formed.

A paste P is placed on the screen 14. The paste P is a material having a high viscosity, which is made, for example, by dissolving a silicone resin, a fluorocarbon resin, a platinum catalyst, carbon, or the like in a solvent. The viscosity of the paste P is in the range of 30 to 200 Pa·s.

A scraper 18 and a squeegee 20, which are respectively movable in the direction of arrow A and in the direction of arrow B while being in contact with the screen 14, are disposed above the screen 14. The scraper 18 and the squeegee 20 are moved by a driving mechanism 21 in the direction of arrow A, in the direction of arrow B, and in the direction of arrow C. The scraper 18 and the squeegee 20 may move in the direction of arrow A and in the direction of arrow B together or independently.

Figure 2:
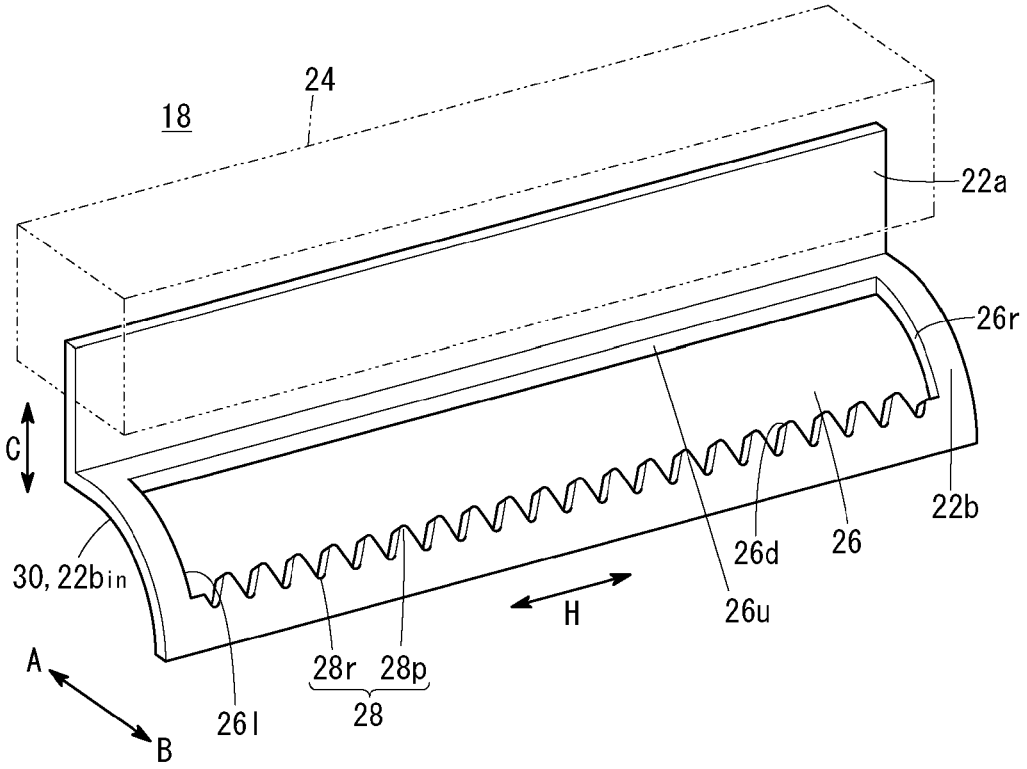
FIG. 2 is a perspective view of a scraper of the printing apparatus.

Referring to FIG. 2, the scraper 18 is made of an anti-corrosive metal material, such as a stainless steel, and extends in a horizontal width direction (direction of arrow H) that crosses the directions in which the scraper 18 moves forward and backward. The scraper 18 includes a vertical portion (or an upper portion) 22*a* that extends toward the screen 14 in a vertical direction, and a curved portion 22*b* that is curved from a lower end of the vertical portion 22*a* in a direction (direction of arrow B) opposite to a moving direction in which the scraper 18 moves to coat the screen 14 with the paste P. The vertical portion 22*a* and the curved portion 22*b* are integrated with each other. The vertical portion 22*a* is fixed to a movable member 24, and the driving mechanism 21 controls movement of the movable member 24.

Figure 3:
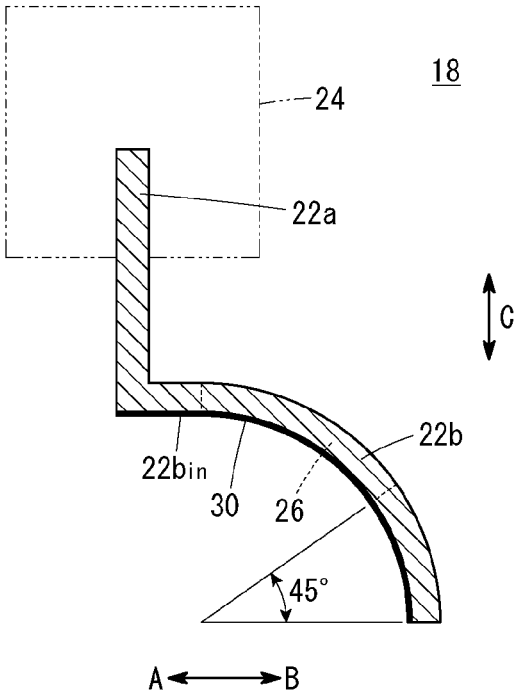
FIG. 3 is a side view illustrating the structure of the scraper.
Figure 4:
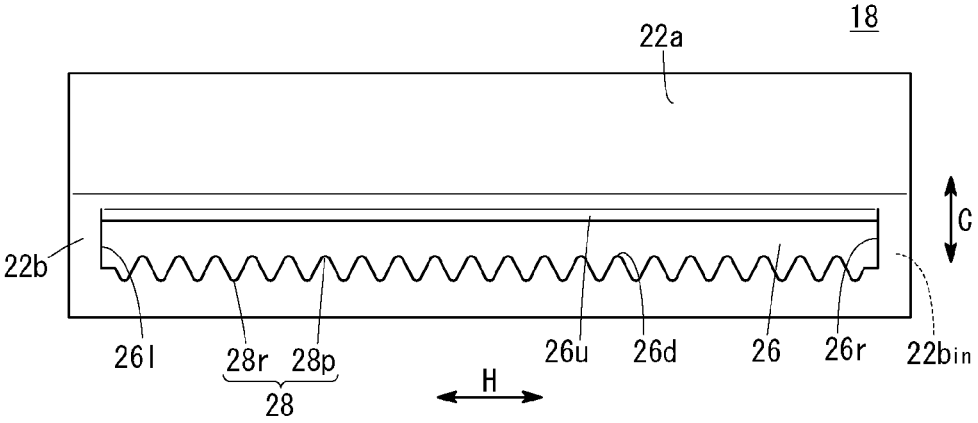
FIG. 4 is a front view of the scraper.

Referring to FIGS. 2 and 3, the curved portion 22*b* includes a horizontal part that extends horizontally from a lower end of the vertical portion 22*a*, a curved part that is curved downward from the horizontal part, and a lower end part that faces downward. Referring to FIGS. 2 and 4, the curved portion 22*b* has an elongated opening 26 that extends in the horizontal width direction.

The opening 26 is defined by a lower wall surface 26*d* and an upper wall surface 26*u*, which are long and extend in the horizontal width direction, and a right wall surface 26*r* and a left wall surface 261, which are short and extend in the vertical direction. The lower wall surface 26*d*, which is adjacent to the screen 14, includes a concave/convex portion 28. The concave/convex portion 28 includes convex portions 28*p*, which are curved so as to protrude upward, and concave portions 28*r*, which are curved so as to be indented downward. Instead of the convex portions 28*p* and the concave portions 28*r*, the lower wall surface 26*d* may have a zigzag shape.

Referring to FIG. 3, the lower wall surface 26*d* of the opening 26 is located at a position at an upward angle of 45° with respect to a horizontal plane, and the opening 26 is formed in an area of the curved portion 22*b* extending from the curved part to the horizontal part of the curved portion 22*b*. This is in order to decrease the frictional force of the paste P and to facilitate removal of the paste P.

Referring to FIG. 3, an area of an inner surface 22*bin* of the curved portion 22*b* that comes into contact with the paste P is provided with a mirror finish, and a water-repellant layer 30 is disposed on the area. The mirror finish improves the slidability of the paste P. The water-repellent layer 30 has a function of reducing sticking of the paste P. The water-repellent layer 30 is formed by performing water-repellent processing (water-repellent treatment), such as fluorocarbon resin coating, on the inner surface 22*bin*.

Referring to FIG. 1, the squeegee 20 is made of an elastic material, such as a rubber, and has a shape that is elongated in the horizontal width direction. The squeegee 20 is disposed so as to be inclined from the vertical direction toward a horizontal direction and is fixed to a movable member 32. The driving mechanism 21 controls movement of the movable member 32.

An operation of the printing apparatus 10, which is constructed as described above, will be described below.

First, referring to FIG. 1, a predetermined amount of paste P is placed at a predetermined position on the screen 14. The scraper 18 is placed at a coating start position (front end position in the direction of arrow B), is positioned at a predetermined height, and is moved translationally in the direction of arrow A with a predetermined speed. Therefore, referring to FIG. 5, the screen 14 is coated with the paste P so that the openings 14*a* are covered by the paste P.

Figure 6:
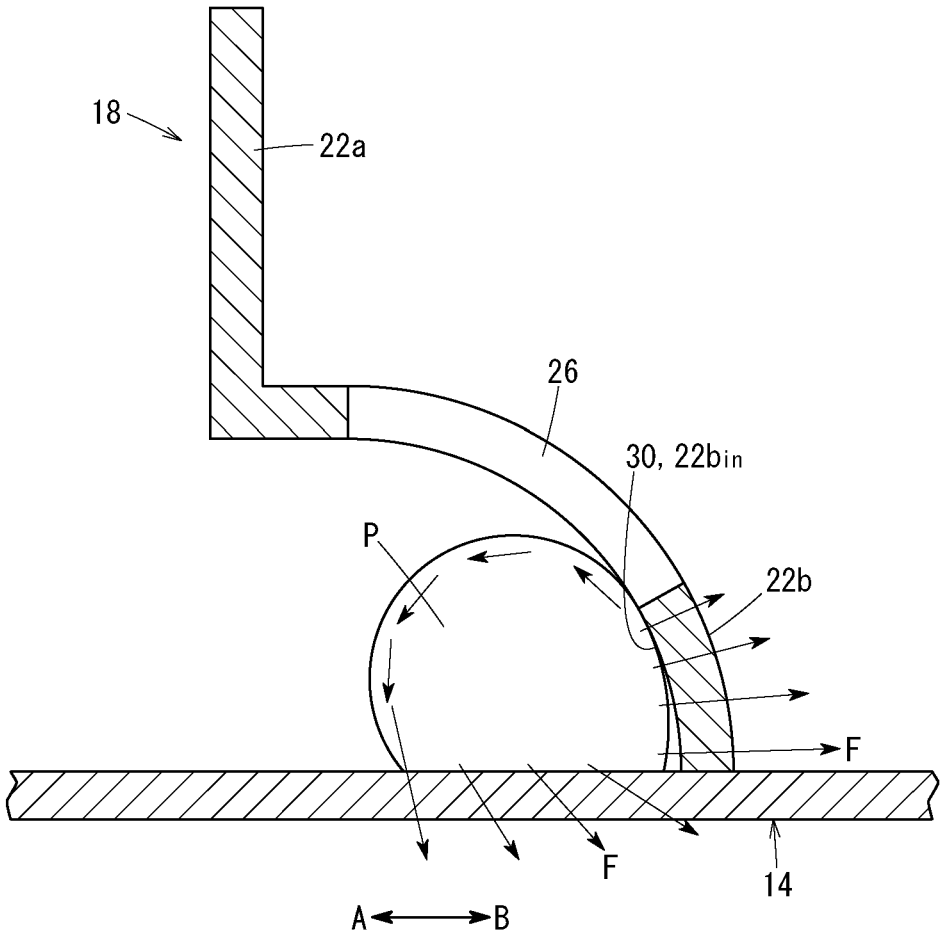
FIG. 6 illustrates how an opening formed in the scraper works.

Referring to FIG. 6, when the scraper 18 moves in the direction of arrow A, forces (reactional forces) F are applied, as indicated by arrows, to portions of the paste P that are in contact with the inner surface 22*bin* of the curved portion 22*b*.

In the present embodiment, the curved portion 22*b* of the scraper 18 has the opening 26, which extends in the horizontal width direction. Accordingly, the paste P moves from a lower position toward an upper position along the inner surface 22*bin* of the curved portion 22*b*, and, due to the presence of the opening 26, a frictional force is considerably reduced or the frictional force is reduced. Thus, the paste P is removed from the inner surface 22*bin* of the curved portion 22*b* and drops from the inner surface 22*bin* due to its own weight, is agitated as the paste P repeatedly rolls, and the screen 14 is uniformly coated with the paste.

Moreover, in the present embodiment, referring to FIGS. 2 and 4, the lower wall surface 26*d*, which is one of wall surfaces defining the opening 26 of the scraper 18 and extending in the horizontal width direction and which is adjacent to the screen 14, includes the concave/convex portion 28. The concave/convex portion 28 includes the convex portions 28*p*, which are curved so as to protrude upward, and the concave portions 28*r*, which are curved so as to be indented downward.

Therefore, on the inner surface 22*bin* of the curved portion 22*b*, the vertex positions of the convex portions 28*p* and the vertex positions of the concave portions 28*r* are located at different heights. Accordingly, the paste P is removed from the inner surface 22*bin* of the curved portion 22*b* at different timings, so that an advantage is obtained in that the rotation speed of the paste P varies and the performance of agitating the paste P is effectively improved.

Furthermore, referring to FIG. 3, the water-repellent layer 30 is disposed on the inner surface 22*bin* of the curved portion 22*b*. Thus, the surface tension of the paste P on the inner surface 22*bin* can be reduced, and sticking of the paste P can be suppressed.

Therefore, the present embodiment has an advantage in that, even if the paste P has a high viscosity, the paste P does not stick to the scraper 18 and a printed product having a desired quality can be obtained easily and reliably.

Figure 5:
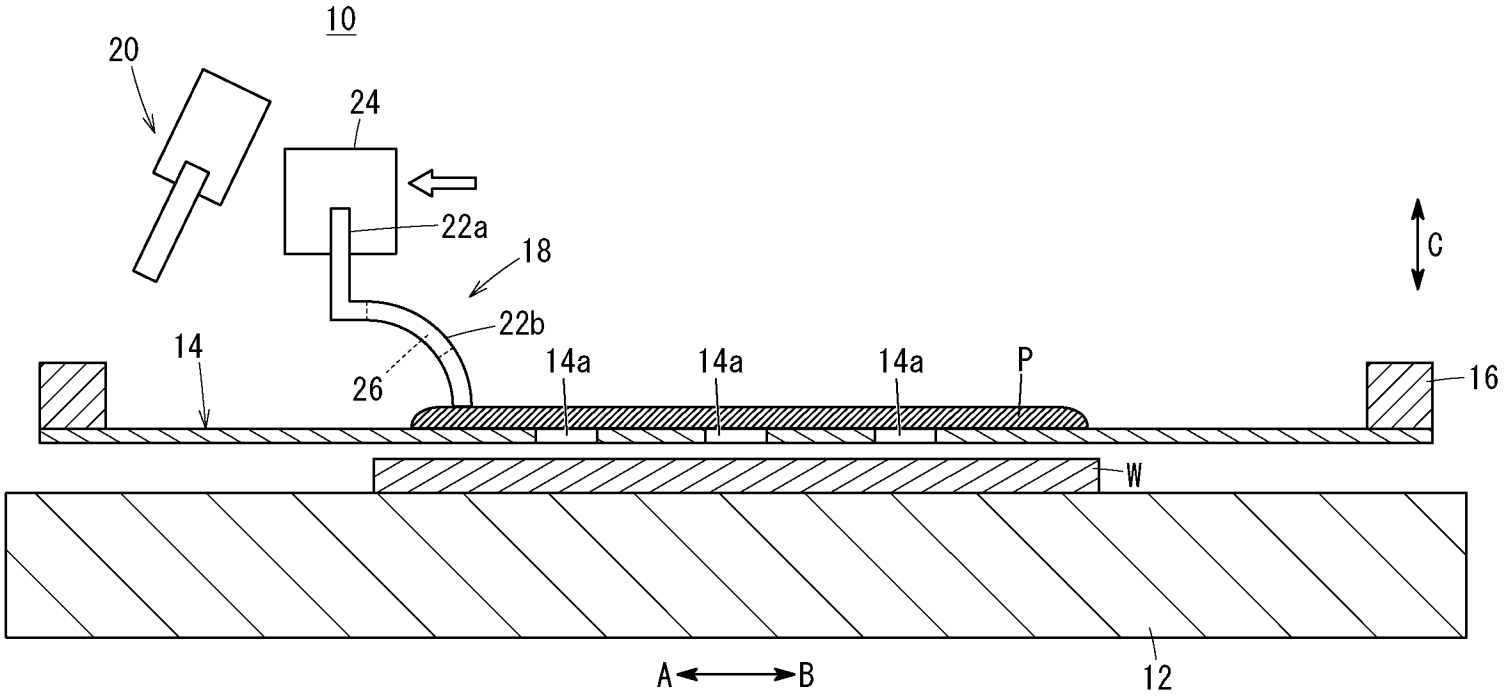
FIG. 5 illustrates how the scraper works when coating a screen with a paste.

Referring to FIG. 5, when the scraper 18 reaches the front end position in the direction of arrow A, coating of the screen 14 with the paste P is finished. Next, the scraper 18 is moved upward, and the squeegee 20 is moved downward to a predetermined height.

Figure 7:
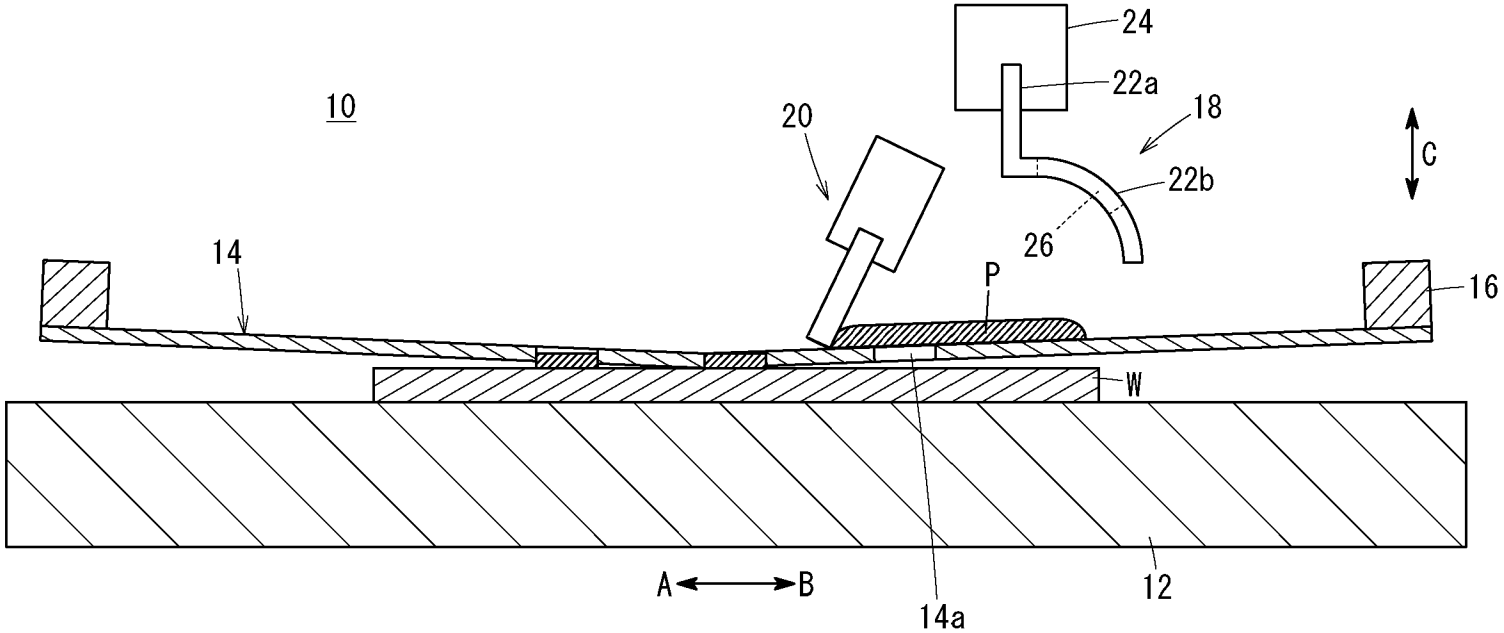
FIG. 7 illustrates how a squeegee of the printing apparatus works.

Referring to FIG. 7, in a state in which the squeegee 20 is in contact with the screen 14, the squeegee 20 is moved translationally in the direction of arrow B with a predetermined speed. Accordingly, the paste P, with which the screen 14 has been coated so as to cover the openings 14*a*, is transferred to the workpiece W through the openings 14*a*, and a desired printed product is obtained.

A printing apparatus according to the present disclosure includes a screen placed on a workpiece, a scraper, and a squeegee. The scraper coats the screen with a paste by moving on the screen. The squeegee transfers the paste, with which the screen has been coated by the scraper, to the workpiece by moving on the screen.

The scraper includes a vertical portion that extends toward the screen in a vertical direction, and a curved portion that is curved from a lower end of the vertical portion in a direction opposite to a moving direction in which the scraper moves to coat the screen with the paste. The curved portion has an opening that extends in a horizontal width direction that crosses the moving direction.

In the printing apparatus, preferably, a lower wall surface, which is one of wall surfaces defining the opening and extending in the horizontal width direction and which is adjacent to the screen, includes a concave/convex portion.

In the printing apparatus, preferably, an inner surface of the curved portion that comes into contact with the paste is water-repellent treated.

With the present disclosure, the curved portion of the scraper has the opening, which extends in the horizontal width direction. Therefore, when the scraper moves on the screen and coats the screen with the paste, the paste moves from a lower position toward an upper position along the curved portion, and, due to the presence of the opening, a frictional force is considerably reduced or the frictional force is reduced.

Accordingly, the paste drops from the inner surface of the curved portion due to its own weight, is agitated as the paste repeatedly rolls, and the screen is uniformly coated with the paste. Thus, even if the paste has a high viscosity, the paste does not stick to the scraper and a printed product having a desired quality can be obtained easily and reliably.

Obviously, numerous modifications and variations of the present invention are possible in light of the above teachings. It is therefore to be understood that within the scope of the appended claims, the invention may be practiced otherwise than as specifically described herein.

What is claimed is:

1. A printing apparatus comprising:

a screen that is placed on a workpiece;

a scraper that coats the screen with a paste by moving on the screen; and a squeegee that transfers the paste, with which the screen has been coated by the scraper, to the workpiece by moving on the screen, wherein the scraper includes a vertical portion that extends toward the screen in a vertical direction, and a curved portion that is curved from a lower end of the vertical portion in a direction opposite to a moving direction in which the scraper moves to coat the screen with the paste, and wherein the curved portion has an opening that extends in a horizontal width direction that crosses the moving direction, the opening formed by a through-hole that extends through the curved portion in the moving direction.

2. The printing apparatus according to claim 1, wherein a lower wall surface, which is one of wall surfaces defining the opening and extending in the horizontal width direction and which is adjacent to the screen, includes a concave/convex portion.

3. The printing apparatus according to claim 1, wherein an inner surface of the curved portion that comes into contact with the paste is water-repellent treated.

4. The printing apparatus according to claim 1, wherein the through-hole that forms the opening extends through the curved portion in the vertical direction.

5. The printing apparatus according to claim 1, wherein the opening is defined by an upper wall surface, a lower wall surface, and a pair of opposed side wall surfaces, each provided in the curved portion.

6. The printing apparatus according to claim 5, wherein a plurality of convex portions protrude from the lower wall surface.

7. A printing apparatus comprising:

a screen having a screen surface which has a width direction and which is to be placed on a workpiece;

a scraper to be movable along the screen surface in a first direction perpendicular to the width direction so as to coat the screen surface with a paste, the scraper comprising:

an upper portion extending from an upper end to a lower end of the upper portion toward the screen surface in a direction perpendicular to the screen surface; and a curved portion connected to the lower end of the upper portion and extending in the width direction, the curved portion having a curved shape projecting toward a second direction opposite to the first direction viewed in the width direction, the curved portion having an opening extending in the width direction, the opening formed by a through-hole that extends through the curved portion in the first direction; and a squeegee to be movable along the screen surface so as to transfer to the workpiece the paste with which the screen has been coated by the scraper.

8. The printing apparatus according to claim 7, wherein a lower wall surface, which is one of wall surfaces defining the opening and extending in the width direction and which is adjacent to the screen, includes a concave/convex portion.

9. The printing apparatus according to claim 7, wherein an inner surface of the curved portion that comes into contact with the paste is water-repellent treated.

10. The printing apparatus according to claim 7, further comprising a print base on which the workpiece is placed.

11. The printing apparatus according to claim 10, further comprising a frame to support the screen such that the screen is disposed above the print base so as to extend parallel to the workpiece.

12. The printing apparatus according to claim 7, wherein the scraper is made of a stainless steel.

13. The printing apparatus according to claim 7, wherein the through-hole that forms the opening extends through the curved portion in the direction perpendicular to the screen surface.

14. The printing apparatus according to claim 7, wherein the opening is defined by an upper wall surface, a lower wall surface, and a pair of opposed side wall surfaces, each provided in the curved portion.

15. The printing apparatus according to claim 14, wherein a plurality of convex portions protrude from the lower wall surface.

16. A printing apparatus comprising:

a screen;

a scraper configured to coat the screen with a paste by moving on the screen; and a squeegee configured to transfers the paste, which coats the screen, to a workpiece by moving on the screen, wherein the scraper includes a vertical portion that extends toward the screen in a vertical direction, and a curved portion that extends from a lower end of the vertical portion in a direction opposite to a moving direction in which the scraper is configured to move to coat the screen with the paste, the curved portion including a pair of side wall surfaces that each extend from the lower end of the vertical portion, and wherein the curved portion has an opening that extends in a horizontal width direction that crosses the moving direction, the opening being disposed between the side wall surfaces in the horizontal width direction.

* * * * *